US006468390B1

(12) United States Patent
Snekkenes et al.

(10) Patent No.: US 6,468,390 B1
(45) Date of Patent: Oct. 22, 2002

(54) METHOD FOR CONTINUOUS COOKING OF LIGNOCELLULOSIC FIBER MATERIAL

(75) Inventors: Vidar Martin Snekkenes; Krister Karl Erik Olsson; Bror Lennart Gustavsson, all of Karlstad; Ernst Mikael Lindström, Stockholm, all of (SE)

(73) Assignee: Kvaerner Pulping AB (SE)

( * ) Notice: Subject to any disclaimer, the term of this patent is extended or adjusted under 35 U.S.C. 154(b) by 28 days.

(21) Appl. No.: 09/139,209

(22) Filed: Aug. 24, 1998

(51) Int. Cl.[7] ..... D21C 3/02; D21C 3/26

(52) U.S. Cl. ..... 162/19; 162/37; 162/38; 162/40; 162/90

(58) Field of Search ..... 162/37, 38, 40, 162/19, 16

(56) References Cited

U.S. PATENT DOCUMENTS 3,802,956 A * 4/1974 Backlund ..... 162/19
3,937,647 A * 2/1976 Backstrom et al. ..... 162/16
5,462,641 A * 10/1995 Bergvist et al. ..... 162/40
5,674,359 A * 10/1997 Chasse et al. ..... 162/19

* cited by examiner

*Primary Examiner*—Steve Alvo
(74) *Attorney, Agent, or Firm*—Fasth Law Offices; Rolf Fasth

(57) ABSTRACT

A method for continuous cooking of lignocellulosic fiber material, comprising the steps of sequentially (a) in a first stage, impregnating the fiber material in an impregnation liquid comprising alkali metal hydroxide, and thereafter withdrawing (14, 514) a spent impregnation liquid; (b) in a second stage, cooking the fiber material in a cooking liquor comprising alkali metal hydroxide; and (c) in a third stage, adding (A), to said fiber material, a liquid which is rich in hemicellulose, said liquid preferably comprising at least a part (14*a*, 514*a*) of said withdrawn spent impregnation liquid. In a fourth stage (d), the fiber material is cooked in a cooking liquor comprising the liquid added in the third stage, whereby the fiber material is subjected to a retention time of at least 1 hour in said fourth stage.

41 Claims, 9 Drawing Sheets

METHOD FOR CONTINUOUS COOKING OF LIGNOCELLULOSIC FIBER MATERIAL

TECHNICAL FIELD

Figure 1:
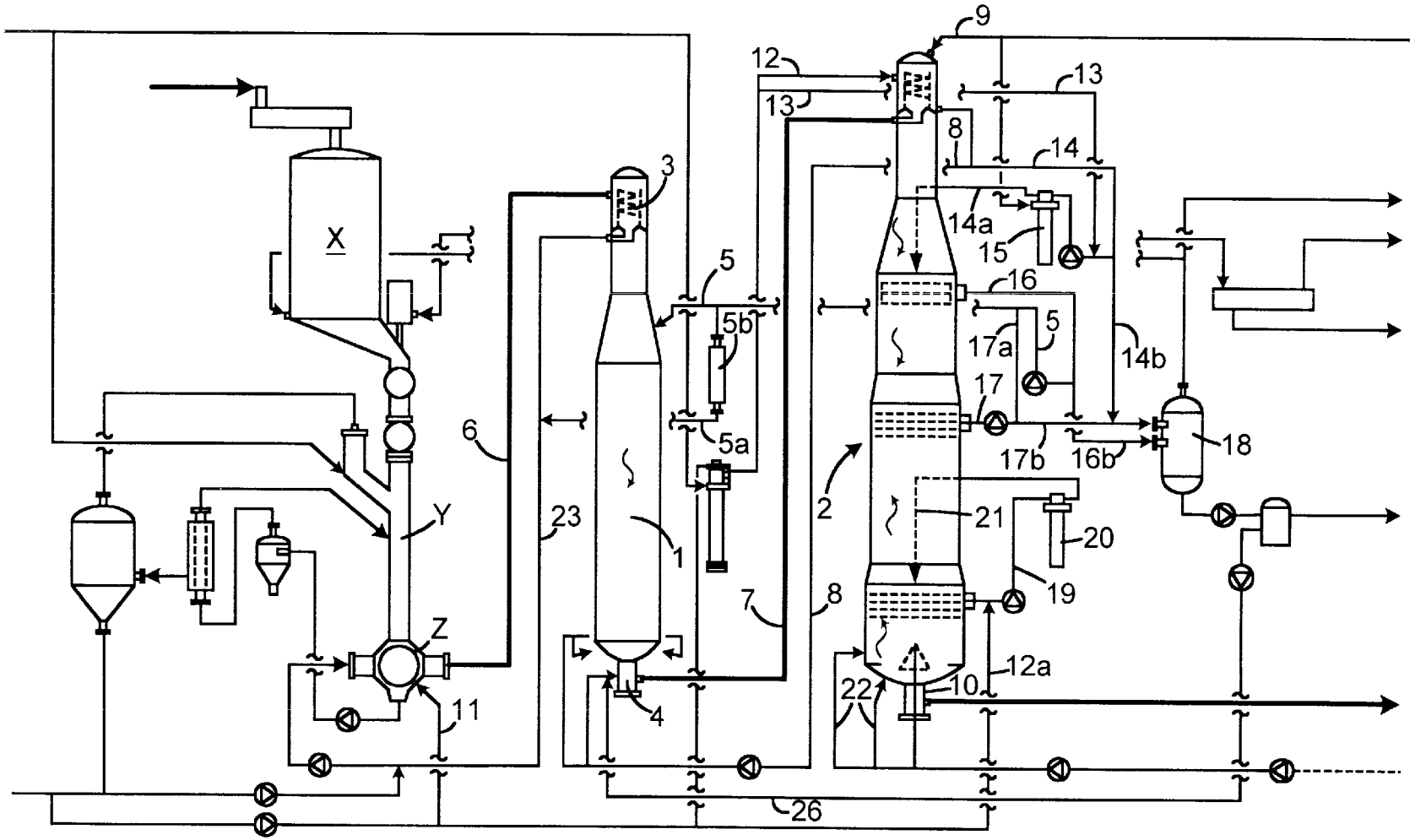

The present invention relates to a method for continuous cooking of lignocellulosic fibre material, comprising the steps of sequentially in a first stage, impregnating the fibre material in an impregnation liquid comprising alkali metal hydroxide, and thereafter withdrawing a spent impregnation liquid; in a second stage, cooking the fibre material in a cooking liquor comprising alkali metal hydroxide; in a third stage, adding, to said fibre material, a liquid which is rich in hemicellulose, said liquid preferably comprising at least a part of said withdrawn spent impregnation liquid.

The object of the method according to the invention is to reintroduce hemicellulose, especially xylan, which is present (dissolved) in the spent impregnation liquid, in contact with the fibre material, so that hemicellulose is precipitated onto the fibres for improved yield and beatability of the pulp which is produced by the method.

BACKGROUND OF THE INVENTION AND PROBLEM

Besides cellulose, lignocellulosic fibre raw material comprises lignin and hemicellulose. The essential purpose of the conventional chemical digestion process of fibre material is to remove the lignin from the fibre material to produce a pulp of cellulose. It is however beneficial to, to a large extent, retain the hemicellulose in the pulp, since the presence of hemicellulose improves yield and beatability. Especially the presence of xylan improves beatability. Xylan is the main hemicellulose in hardwood, i.e. about 30% of the dry wood material, while softwood contain only about 10% xylan. Contrary to cellulose, xylan does not show a crystalline structure, but is branched, which means that it is in principle water soluble. Xylan is especially dissolved into a hydroxide ion containing solution, due to its carboxylic acid groups. These carboxylic acid groups will however be successively cleaved off during the digestion, which leads to the solubility being decreased, especially if also the concentration of hydroxide ions in the solution is decreased during the digestion process.

From U.S. Pat. No. 3,617,431 there is known a process for preparing cellulose pulp by alkaline digestion while inhibiting extraction of hemicellulose by employing an alkaline cooking liquor having a high concentration of substantially nondegraded hemicellulose. In the process, said alkaline cooking liquor is withdrawn from a location in the upper part of the digester, whereafter it is cooled and introduced in the top of the digester.

U.S.Pat. No. 3,802,956 is presenting a method for impregnation of cellulosic fibre material, where the fibre material is preimpregnated in a preimpregnation vessel which includes two screen sections with a counter current impregnation zone there between and extraction of spent impregnation liquid at the upper screen section. The method includes the possibility to introduce a part of this spent impregnation liquid at a location which corresponds to the extraction screen in a subsequent continuous digester in order to utilise a possible alkali content thereof. The method is not concerned with the problem of retaining hemicellulose in the pulp and will moreover not have this effect. This is understood by the stage which precedes the digester extraction screen being a concurrent stage and the stage which succeeds the digester extraction screen being a counter current washing stage, which means that the spent impregnation liquid which is introduced at the location of the digester extraction screen must leave the digester through this screen and consequently will not have any retention time worth mentioning in the digester.

The present invention is concerned with the problem of achieving good yield and beatability by keeping a high content of hemicellulose, especially xylan in the pulp. It would be especially beneficial to have the xylan on the outside of the fibres, since the xylan molecules on different fibres thereby would be able to co-operate with each other to give good beatability. It also desired to achieve a cost effective method to produce a pulp with a low kappa number while preserving good strength properties, while, if possible, excluding the counter current wash stage which conventionally is combined with so called modified continuous cooking, extended modified continuous cooking or isothermal cooking (ITC™).

SHORT DESCRIPTION OF THE INVENTION

The above problem is solved by allowing hemicellulose which is dissolved during impregnation of the fibre material to precipitate on the fibres in a subsequent stage of the digestion process. This is achieved by a method for continuous cooking of lignocellulosic fibre material, comprising the steps of sequentially (a) in a first stage, impregnating the fibre material in an impregnation liquid comprising alkali metal hydroxide, and thereafter withdrawing (14, 514) a spent impregnation liquid, (b) in a second stage, cooking the fibre material in a cooking liquor comprising alkali metal hydroxide, (c) in a third stage, adding (A), to said fibre material, a liquid which is rich in hemicellulose, said liquid preferably comprising at least a part (14*a*, 514*a*) of said withdrawn spent impregnation liquid, characterised by (d) in a fourth stage, cooking the fibre material in a cooking liquor comprising the liquid added in the third stage, whereby the fibre material is subjected to a retention time of at least 1 hour in said fourth stage.

According to one aspect of the invention, said impregnation liquid in said first stage (a) essentially consists of spent cooking liquor.

According to another aspect of the invention, said fourth stage (d) is performed with a retention time of at least 1,5 hours.

According to another aspect of the invention, a fresh liquid comprising alkali metal hydroxide, preferably a white liquor, is added to said second stage (b), so that said cooking liquor in stage (b) obtains a concentration of effective alkali, calculated as NaOH, of at least 20 g/l, preferably 30–50 g/l and more preferred about 40 g/l, for softwood, or at least 10 g/l, preferably 12–25 g/l and more preferred about 15 g/l, for hardwood. Also, a fresh liquid comprising alkali metal hydroxide, preferably a white liquor, can be added to the fibre material together with said hemicellulose rich liquid in stage (c).

According to yet another aspect of the invention, a first spent cooking liquor is withdrawn from said second stage (b) and a substantial part of this first spent cooking liquor, preferably at least 80%, more preferred at least 90% and optimally about 100%, is supplied to the impregnation in said first stage (a), preferably to the beginning of said first stage (a). Possibly, the spent impregnation liquid which is added to the first stage (a) may provide all the alkali metal hydroxide necessary for that stage, there being no need for any addition, or possibly only need for a minor addition, of fresh alkali metal hydroxide to the first stage (a).

According to another aspect of the invention, said hemicellulose rich liquid, which constitutes a part of the cooking liquor in the fourth stage (d) of the method, may be transferred from an impregnation stage in a fibre line for digestion of hardwood fibre material, to a continuous fibre line system for digestion of softwood fibre material. Although the embodiments which are described in connection with the drawings show only one fibre line, it is to be understood that the preferred features regarding for example retention times, temperatures, flows etc. would be applicable also in the case of two fibre lines.

According to still another aspect of the invention, the method can be performed in connection with continuous chemical digestion, preferably a kraft digestion process, which employs a so called single vessel system or a so called two vessel system, which systems may be of hydraulically liquid filled type or of steam/liquor-phase type. Moreover, the preimpregnation vessel in a two vessel system operates preferably in a concurrent way, i.e. both the fibre material and the liquid flow in the same direction, possibly with somewhat different speed however. The digester, on the other hand, may independent of type, operate with certain zones being concurrent and other being counter current, whereby it is preferred that the entire digester, apart from the very last wash stage, which has a retention time of at most about 60 minutes, but preferably at least about 10 minutes, operates in a concurrent manner. This means that the design which have been used for the last decades, including a counter current zone, often called modified continuous cooking, extended modified continuous cooking or ITC™ , below the extraction screens, in some cases can be abandoned.

SHORT DESCRIPTION OF THE DRAWINGS

Figure 2:
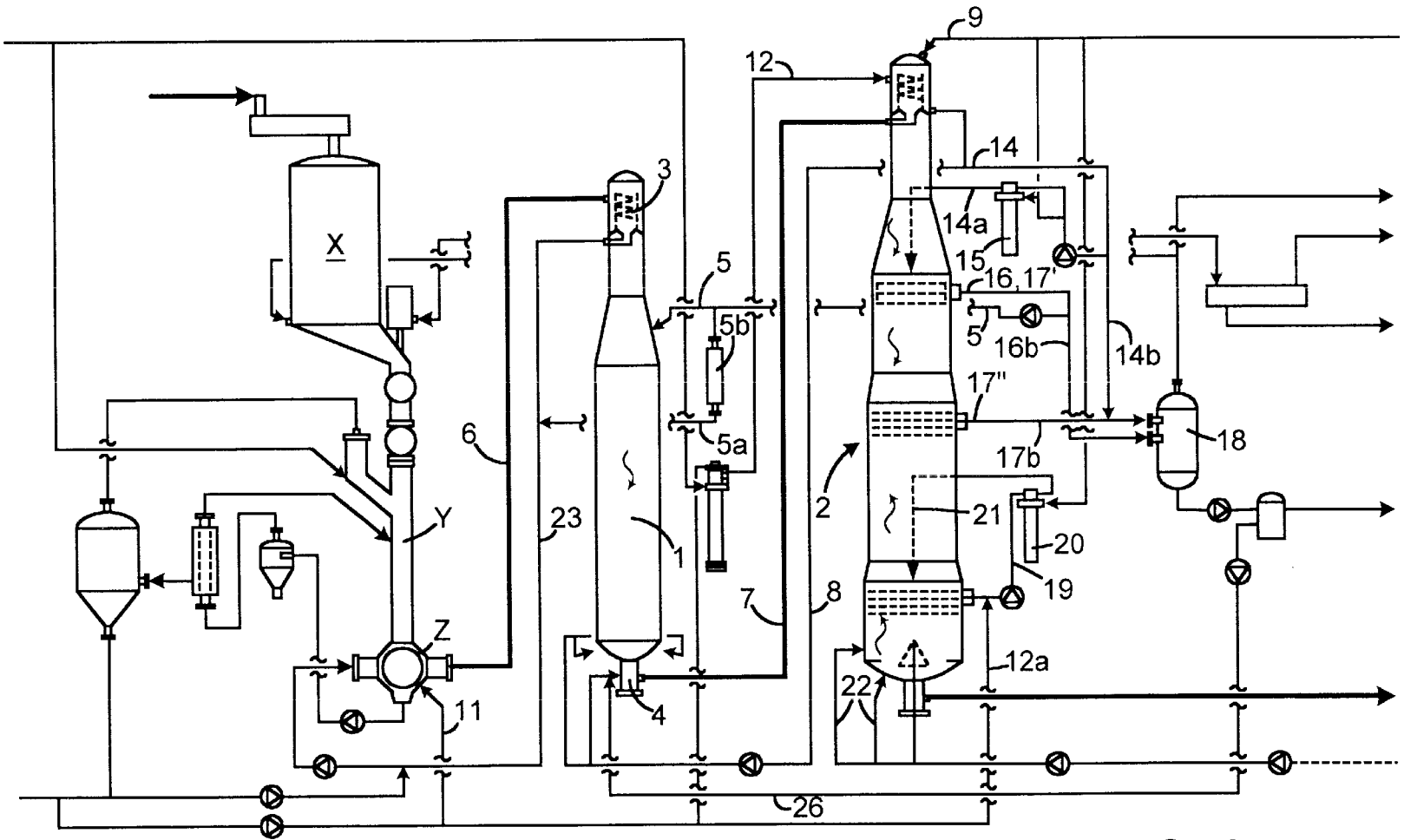
Figure 3:
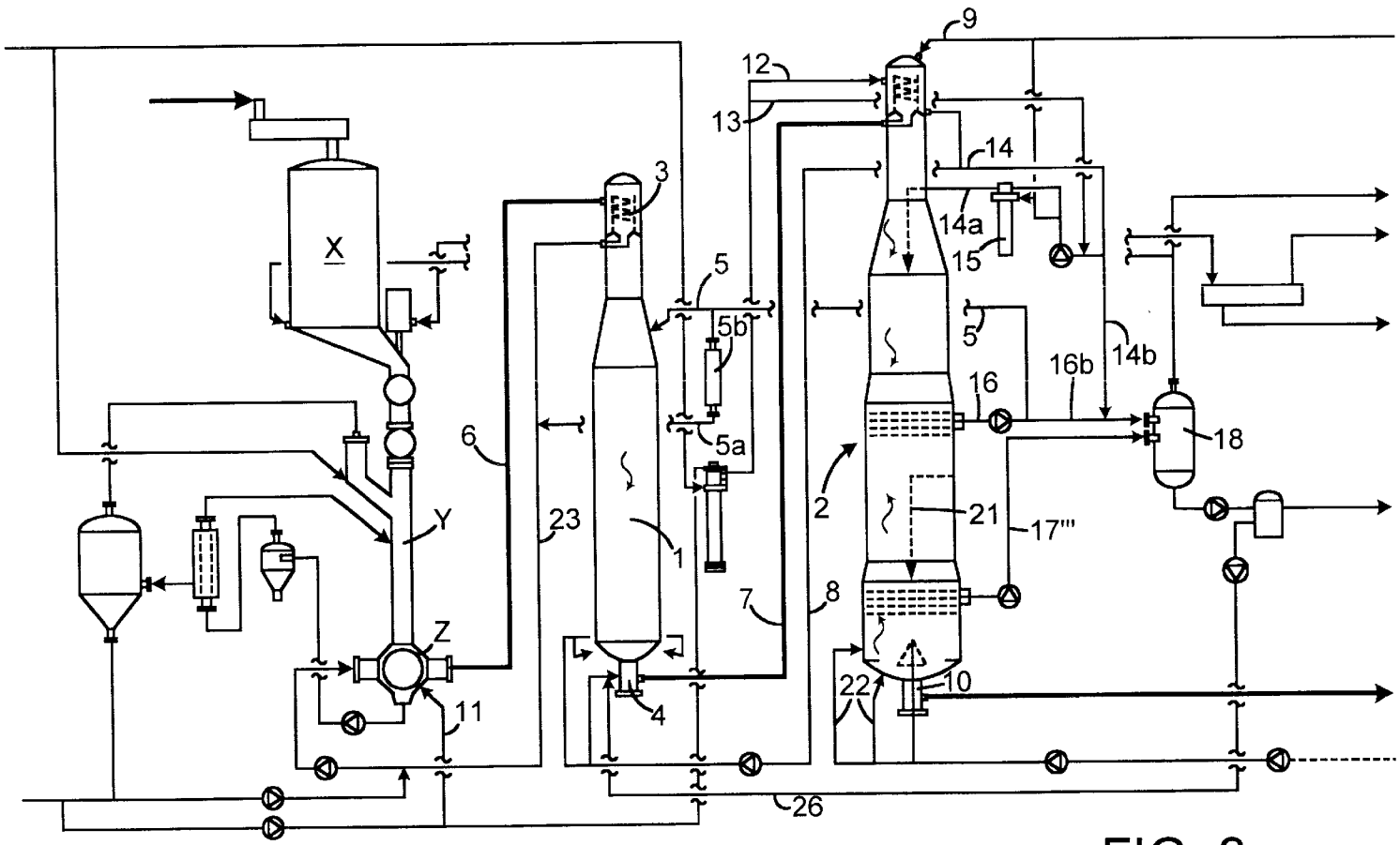
Figure 4:
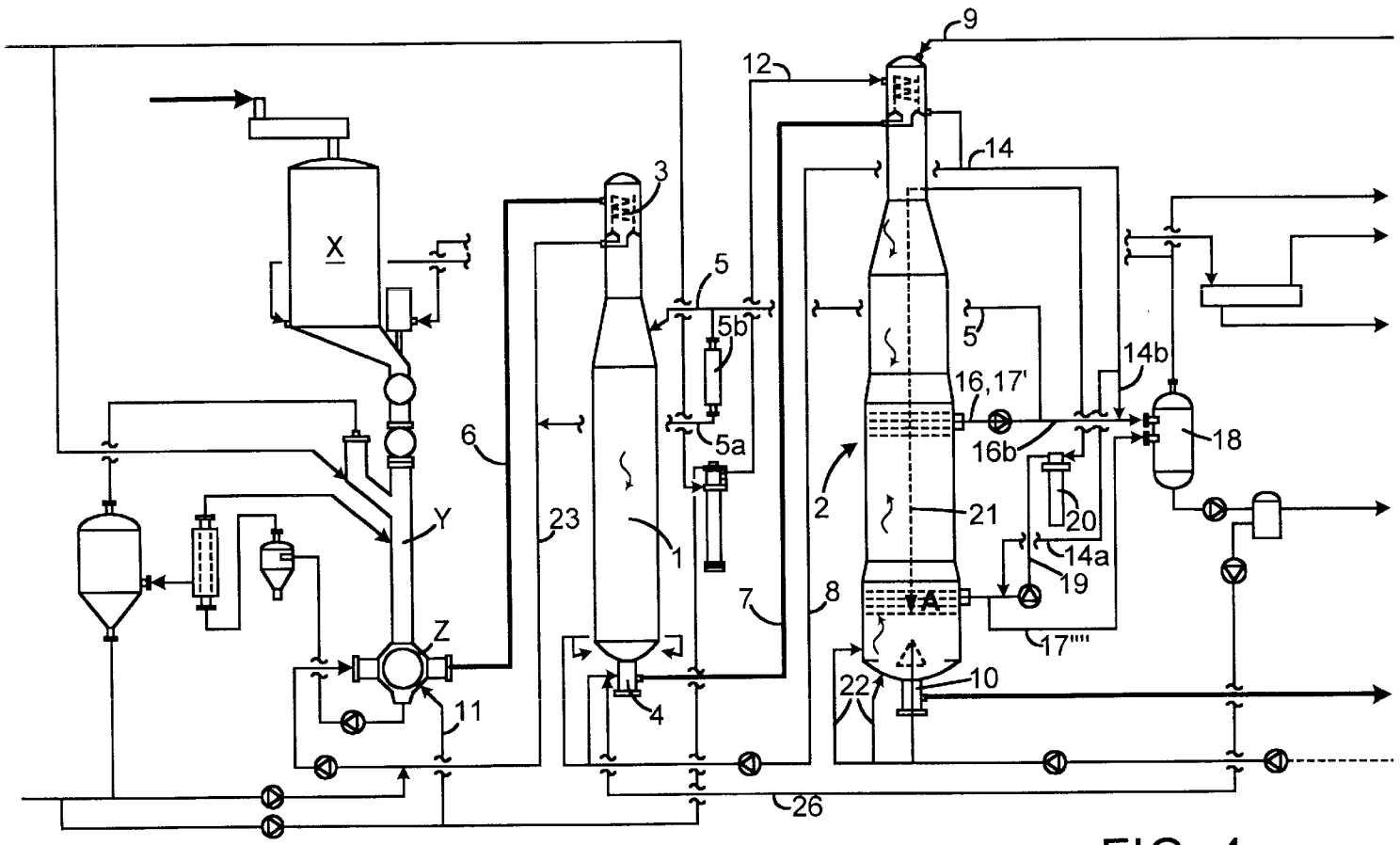
Figure 5:
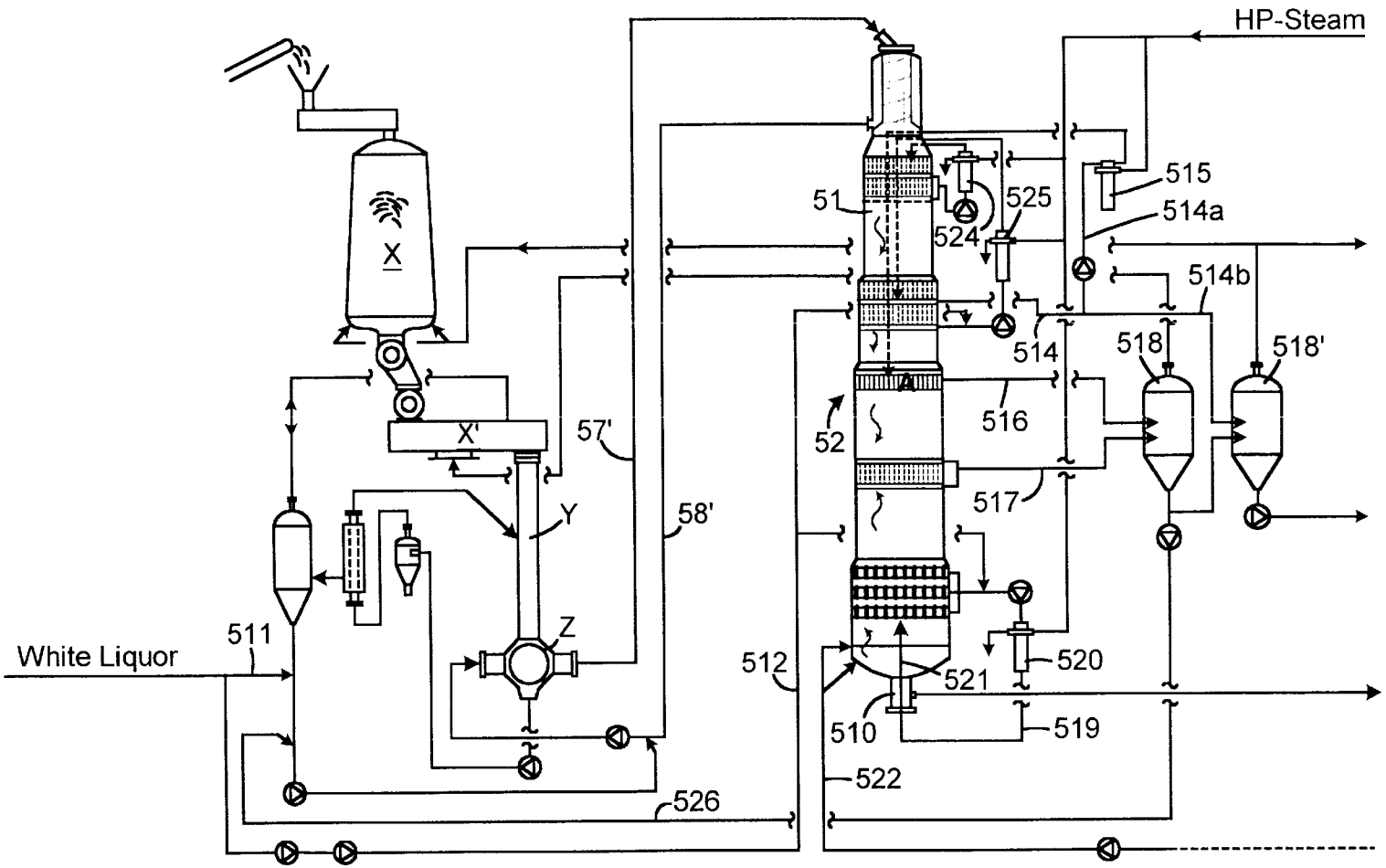
Figure 6:
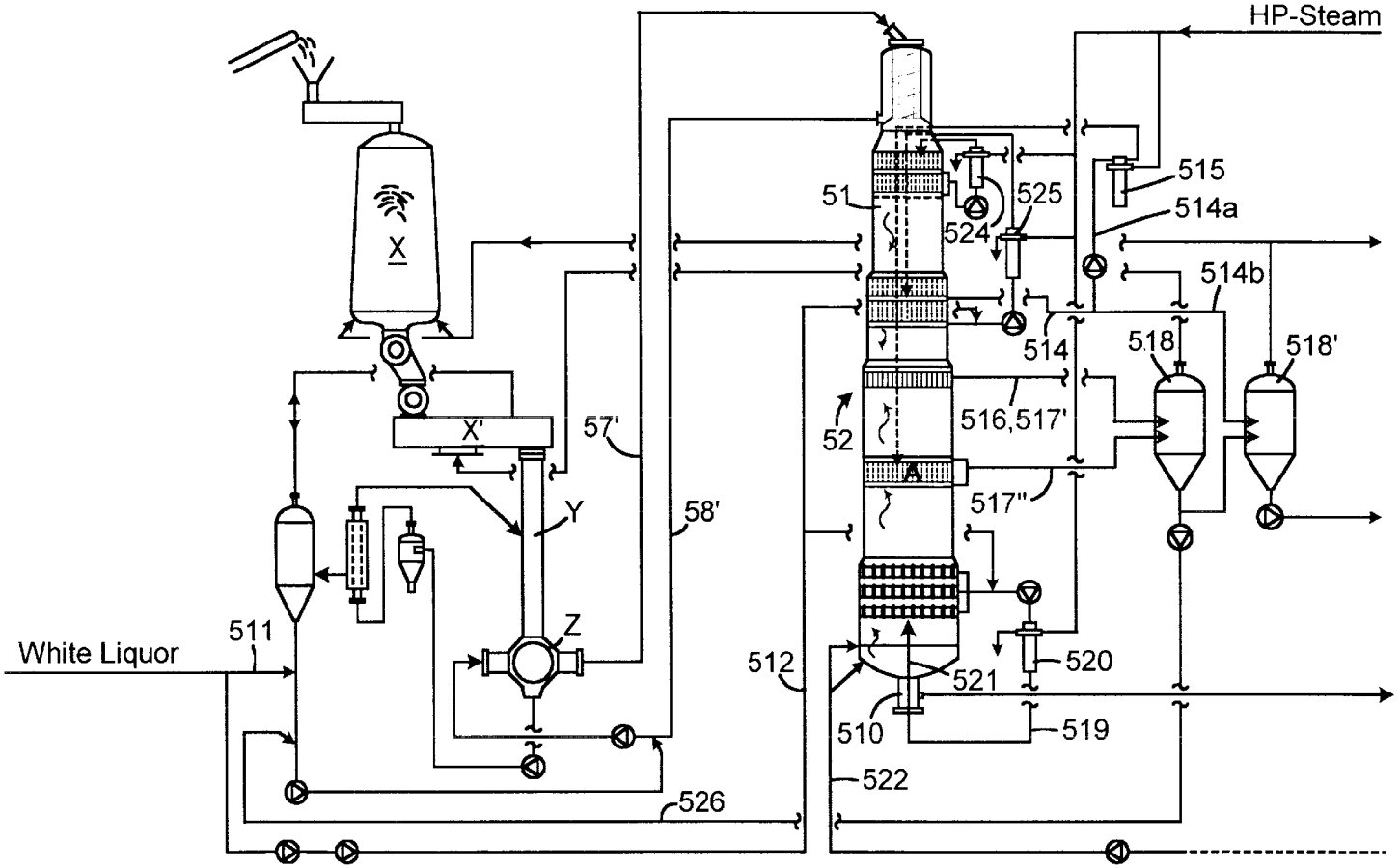
Figure 7:
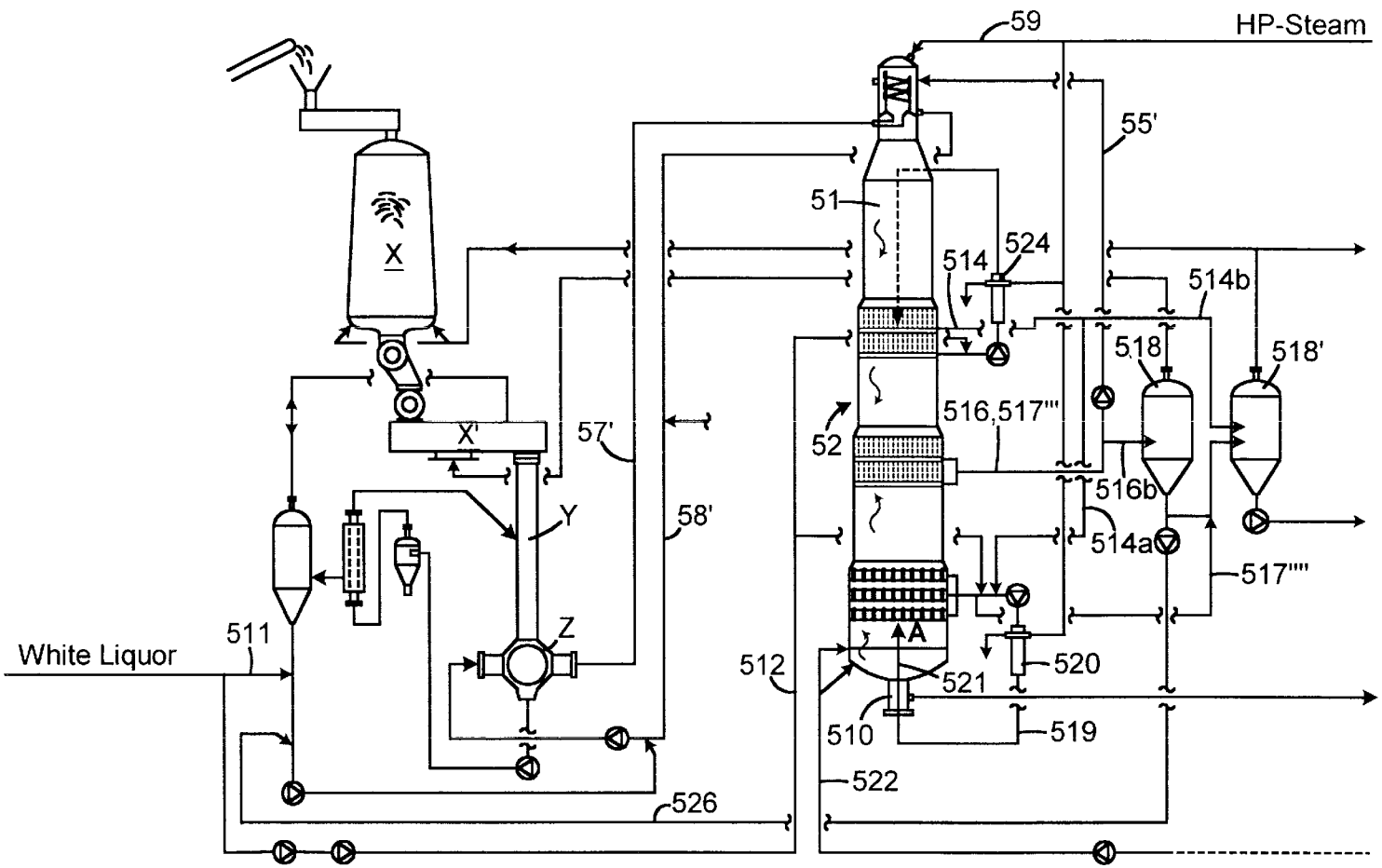
Figure 8:
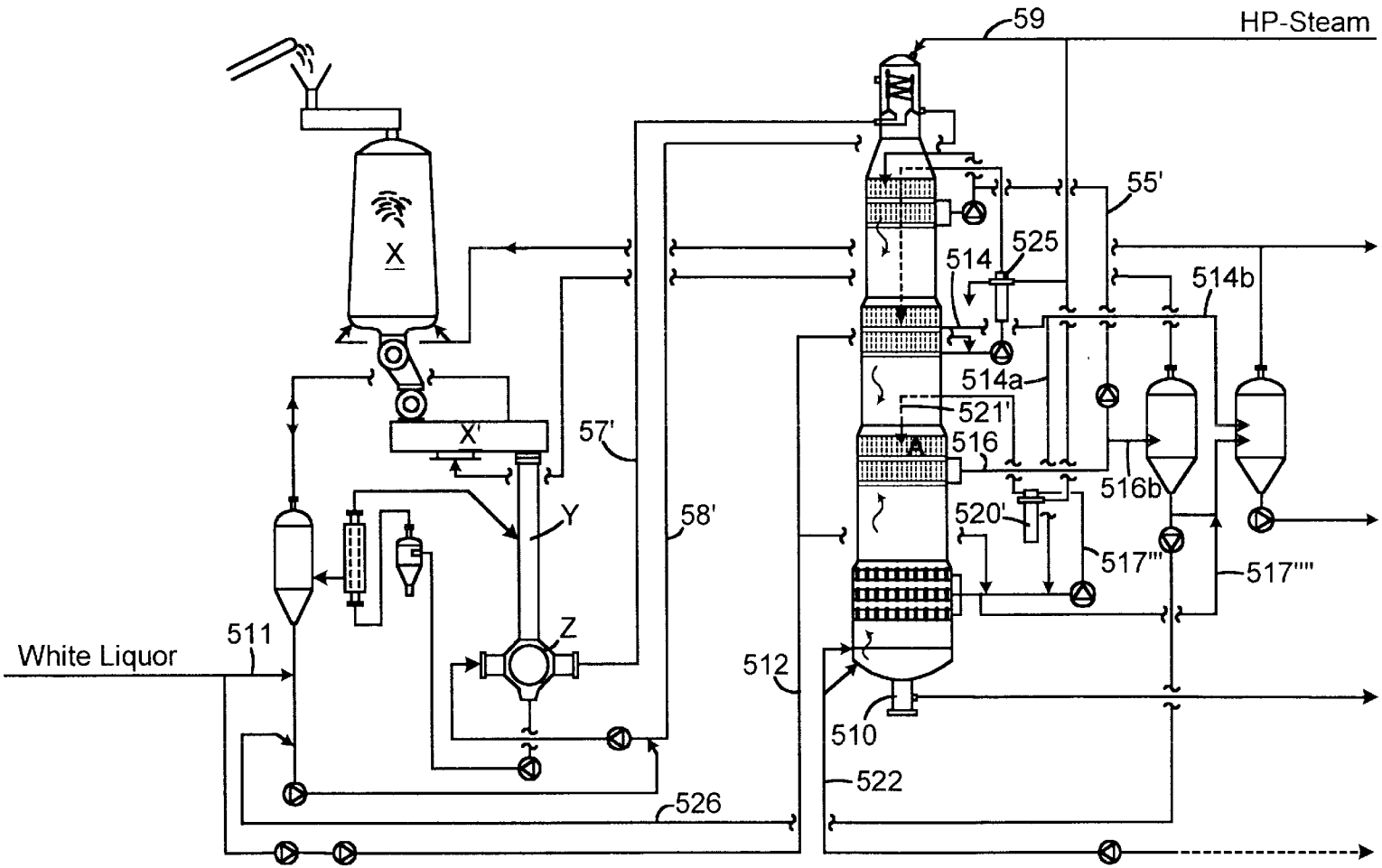

Additional characters and aspects of the invention are apparent from the enclosed claims and from the following detailed description with reference to the drawings, of which:

FIG. 1 is showing a two vessel, steam/liquor phase system, the digester comprising two concurrent cooking stages and a counter current ITC™ stage, FIG. 2 is showing a two vessel,. steam/liquor phase system, the digester comprising one concurrent cooking stage, one counter current cooking stage and a counter current ITC™ stage, FIG. 3 is showing a preferred two vessel, steam/liquor phase system, the digester comprising two concurrent cooking stages, FIG. 4 is showing a two vessel, steam/liquor phase system, the digester comprising one concurrent cooking stage and one counter current cooking stage, FIG. 5 is showing a single vessel, hydraulic type system, the digester comprising one concurrent impregnation stage, two concurrent cooking stages and one counter current ITC™ stage, FIG. 6 is showing a single vessel, hydraulic type system, the digester comprising one concurrent impregnation stage, one concurrent cooking stage, one counter current cooking stage and one counter current ITC™ stage, FIG. 7 is showing a single vessel, steam/liquor-phase system, the digester comprising one concurrent impregnation stage, one concurrent cooking stage and one counter current cooking stage (including ITC™), FIG. 8 is showing a preferred single vessel, steam/liquor-phase system, the digester comprising one concurrent impregnation stage and two concurrent cooking stages.

Figure 9:
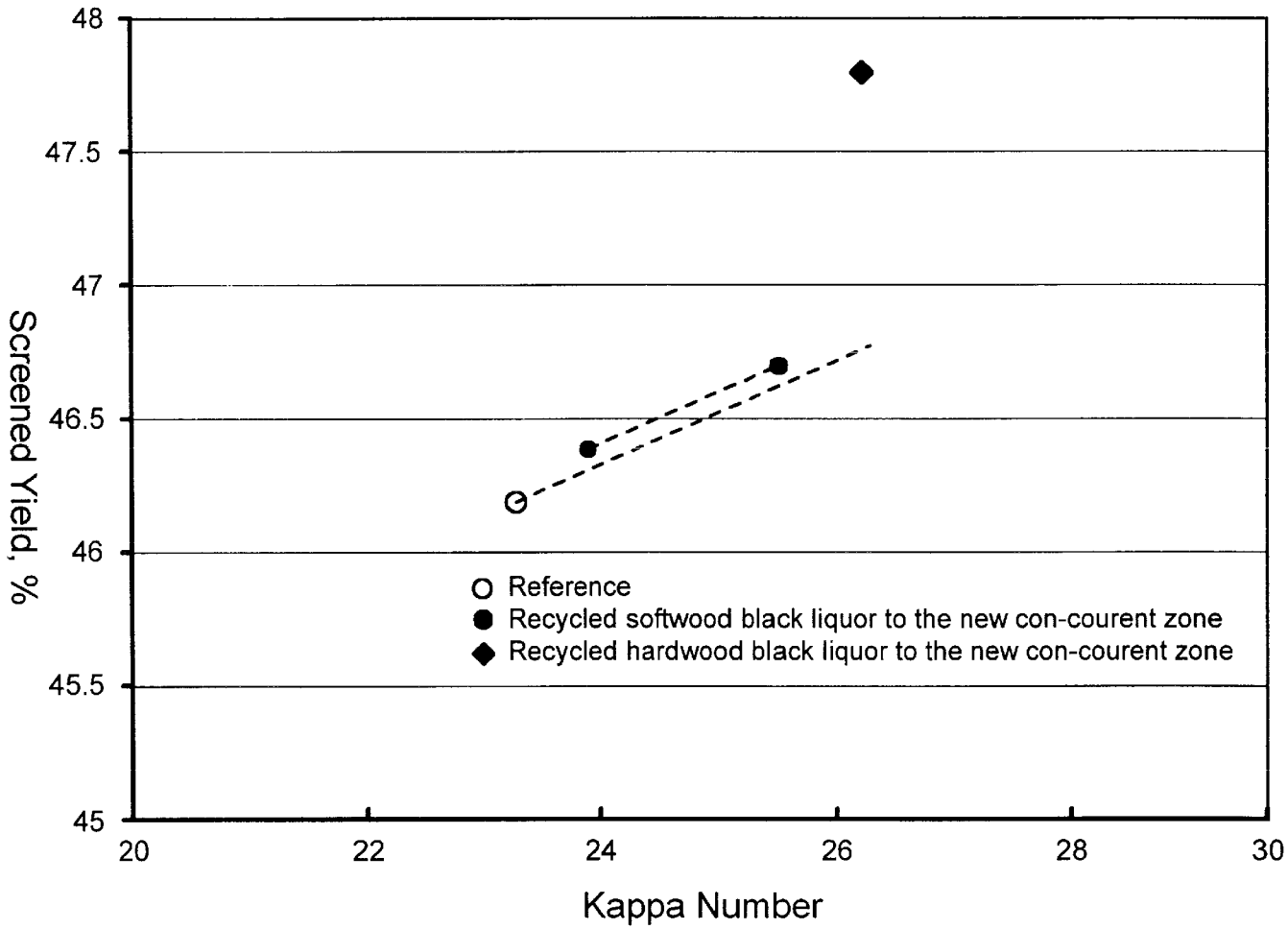

FIG. 9 is a diagram showing improved yield in laboratory tests according to the present invention.

DETAILED DESCRIPTION OF THE DRAWINGS

Common for all the alternatives according to the drawings is that the digester also comprises a lowermost, short washing stage. The direction of flow of fibre material in the shown preimpregnation vessels and digesters is always downwards. The direction of liquid flow in the preimpregnation vessels and in the different stages of the digesters has been indicated by "wavy" arrows. The point of addition of hemicellulose rich liquid, preferably spent impregnation liquid, in the digester, has been indicated by the letter "A". Furthermore, it is a general aspect of a preferred embodiment of the invention that the digester comprises at least two cooking stages, where the first one is operated with a relatively high content of effective alkali, and the subsequent one, which suitably follows immediately after the first one, is operated with a relatively high content of hemicellulose, especially xylan. According to another aspect of the invention, said first cooking stage may be operated at a lower content of effective alkali, while the second cooking stage is operated with a relatively high content of hemicellulose, especially xylan. The second cooking stage should have a considerable retention time, in order for the xylan in the liquor to precipitate onto the fibres, due to cleavage of carboxylic acid groups and, by consumption by the fibre material, lowered concentration of alkali metal hydroxide.

Turning now to FIG. 1, showing a two vessel, steam/liquor phase system for producing pulp according to the invention, the main components consist of a preimpregnation vessel 1 and a steam/liquor-phase digester 2.

The preimpregnation vessel 1, which normally is totally filled with liquid, presents a feeding-in device 3 of conventional type at the top, and a feeding-out device 4, comprising a bottom scraper (not shown), at the bottom. In addition to this, there is a conduit 5 for adding a hot spent cooking liquor, preferably to the upper portion of the preimpregnation vessel 1. In contrast to conventional preimpregnation vessels no extraction screen is located on the vessel. Furthermore, both the fibre material and the liquid flow downwards through the entire preimpregnation vessel. The fibre material, i.e. the chips, is fed from the chip bin X, through the chip chute Y and is further conveyed in a conduit 6 to the top of the preimpregnation vessel 1 by aid of the high pressure feeder Z, which may be lubricated by a minor amount of white liquor 11. In the top of the preimpregnation vessel, there is a top separator device which separates a part of the liquid in which the fibre material was entrained in the conduit 6, for return 23 to the high pressure feeder Z. In the preimpregnation vessel, the fibre material is, as a first stage of the present method, preimpregnated in a concurrent manner, with hot spent cooking liquor, supplied through the conduit 5. Also a part of the hot spent cooking liquor in conduit 5 may be supplied to the return conduit 23 through a branch conduit 5*a* which includes a cooler 5*b*, in order to prevent undesired high temperatures in the feeding system. The liquor-to-wood ratio in the preimpregnation vessel should be between 4:1–10:1, preferably between 5:1–9:1 and more preferred between 6:1–8:1.

A transfer circulation 7, 8 is arranged to convey the fibre material from the bottom of the preimpregnation vessel to the top of the digester 2, including a top separator device in the top of the digester. Separated liquid is returned to the feeding out device 4 of the preimpregnation vessel 1 by the conduit 8. Reject liquor 26 from the fibre screen is led to the transfer circulation 7, 8. To the top of the digester, there is also added steam 9, the figure showing a steam/liquor-phase digester. At the bottom of the digester there is a feeding-out device 10 including a scraping element. Preferably, the feeding-out is performed as "cold-blow", which means that the temperature of the fibre material is being cooled down at the bottom of the digester with the aid of relatively cold (preferably 70–90° C.) wash liquid which is added by means of the scraping element and/or other inlets 22 to the digester bottom, and then subsequently conducted upwards counter current the fibre material.

The digester also presents three screen sections, which divide the digester into four zones. The uppermost zone or stage is thereby a concurrent cooking stage which constitutes a second stage of the present method of invention, and which is operating at a relatively high level of effective alkali. The effective alkali, calculated as NaOH, should be at least 20 g/l, preferably 30–50 g/l and more preferred about 40 g/l, for softwood, or at least 10 g/l, preferably 12–25 g/l and more preferred about 15 g/l, for hardwood. This is achieved by the supply 12 of a liquid comprising fresh alkali metal hydroxide, preferably a white liquor, to the top of the digester. Preferably more than 60% of the total amount of white liquor added to the entire system is added to the top of the digester in the case of softwood cooking and preferably more than 30% in the case of hardwood cooking. This second stage cooking is furthermore performed at a relatively low cooking temperature, i.e. between 130–160° C., preferably between about 140–150° C., the temperature suitably near the upper limit for softwood and near the lower limit for hardwood. If the retention times are short, the temperature may however be higher. The retention time should however be at least 20 minutes, preferably at least 30 minutes and more preferred at least 40 minutes. The liquor-to-wood ratio should be between 2:1 and 7:1, preferably between 3:1–5.5:1, more preferred between 3.5:1–5:1. At the end of this second stage of the method, a first spent cooking liquor is withdrawn 16, of which, due to its relatively high content of residual alkali, a substantial part is conveyed 5 to the upper part of the preimpregnation vessel 1 to constitute at least a part of the preimpregnation liquid. Preferably at least 80%, more preferred at least 90%, and optimally about 100% (which normally is about 8–12 $m^3$/ADMT) of the liquor withdrawn in the conduit 16 is conveyed to the preimpregnation vessel. Optionally, but not shown, the recirculated part 5 of the first spent cooking liquor may be lowered in temperature, e.g. by aid of a flash tank, cooler or heat exchanger, before being introduced in the preimpregnation vessel 1.

Also at the end of the uppermost stage (second stage of the method), a spent impregnation liquid is added (third stage of the method), by means of a hanging central pipe, at a point "A". This spent impregnation liquid constitutes at least a part 14*a* of a spent impregnation liquid which is withdrawn from the impregnation stage by means of a branch conduit 14 from the return conduit 8 of the transfer circulation 7, 8. The part 14*a* of the spent impregnation liquid which is added to the digester at the point "A" is suitably heated by means of a heat exchanger 15, before the addition, so that approximately the same temperature is maintained in the subsequent concurrent cooking zone (fourth stage of the method according to the invention) as in the preceding concurrent cooking zone. Also the same liquor-to-wood ratio is preferably maintained although the liquor-to-wood ratio may somewhat lower or in some cases even higher. The purpose, according to the invention, of the addition is to supply a liquid which is rich in hemicellulose, especially xylan, to the fibre material at a location and in a stage, where a considerable amount of the hemicellulose (xylan), due to the conditions of the stage, will precipitate onto the fibre material to give improved yield and beatability properties. In order for the precipitation to take place, the fourth stage of the method according to the invention should have a retention time of at least 1 hour, preferably at least 1.5 hours, whereby cleavage of carboxylic acid groups in the xylan will cause decreased solubility of the xylan, especially since the level of effective alkali and thereby hydroxide ions is lowered towards the end of the stage by consumption by the fibre material. Although a relatively low level of effective alkali is desired, preferably about 2–10 g/l at the end of the stage (seen from fibre material flow point of view), the method includes the possibility to add a liquid 13 comprising fresh alkali metal hydroxide, preferably white liquor, to the fourth stage of the method, in order for the digestion process to continue and for avoidance of precipitation of lignin.

At the end of the concurrent cooking stage comprising a high level of hemicellulose, a second spent cooking liquor 17 is withdrawn, of which at least a part 17*b*, having a residual alkali level of about 2–10 g/l, is led to recovery via a flash tank 18. The remaining part 17*a*, if any, can be led to the preimpregnation vessel together with the liquid in conduit 5. To recovery, via the flash tank 18, is also led a remaining part 14*b* of the spent impregnation liquid which is withdrawn from return conduit 8 by branch conduit 14. The withdrawn spent impregnation liquid in branch conduit 14 is divided so that at least 20%, preferably at least 30% and more preferred at least 40% of the liquid is supplied, via conduit 14*a*, to the digester, whereas the remaining part 14*b* is led to recovery. Furthermore, a minor, remaining part 16*b* of the first spent cooking liquor 16 may be led to recovery via flash tank 18.

Below the point, i.e. the screen section, for withdrawal of said second spent cooking liquor 17 is a conventional ITC™ stage, which is a counter current stage for combined isothermal cooking and wash. The concept of ITC™ is described in WO94/11566 and is based on the principle of keeping almost the same temperature (relatively low compared to prior art) in all cooking stages in combination with moderate levels of effective alkali. Thus, the temperature is upheld in the lower part of the digester (excluding the concluding wash stage) by a circulation arrangement which includes a conduit 19 for withdrawing liquor from a lowermost screen section, a heat exchanger 20 and a hanging central pipe 21 for reintroduction of the liquor into the digester. White liquor, preferably about 10–15% of the total amount of white liquor, is added to the ITC™ stage via conduit 12*a*. Since the liquor flow in counter current to the fibre material in the ITC™ stage, the second spent cooking liquor withdrawn at 17 will also contain spent liquor from the ITC™ stage.

As an alternative to a conventional ITC™ stage, the counter current stage can be performed with a temperature which is somewhat higher (for example 5–10° C. higher than the temperature in the concurrent stages).

The concluding stage of the digester 2 is a counter current wash stage, preferably arranged to permit "cold blow" of the pulp as described above.

In the following description of embodiments according to FIGS. 2–4, the same reference numerals are used for details which correspond directly to details with the same reference numerals in FIG. 1. Moreover, the general principle of operation, as concerns the method of the invention, is essentially the same, why FIGS. 2–4 will not be described in detail. Only the essential differing features are described in the following.

FIG. 2 is showing a two vessel, steam/liquor phase system, the digester comprising one concurrent cooking stage, one counter current cooking stage and a counter current ITC™ stage. In this system, the counter current cooking stage constitutes the fourth stage of the method according to the invention, i.e. the cooking stage with a high content of hemicellulose (xylan). Due to the stage being counter current, the part 14*a* of the spent impregnation liquid 14, is added "A" at the end of the stage, seen from fibre material point of view, which of course is the beginning of the stage, seen from liquid point of view. This will, in turn, mean that the first spent cooking liquor 16 is withdrawn from the digester at the same location as, and consequently together with, the second spent cooking liquor 17'. According to the invention, a major part of this combined liquor 16, 17' is conveyed 5 to the preimpregnation vessel 1 and another part is led 16*b* to recovery via the flash tank 18. The spent liquor 17" from the ITC™ stage is also led to recovery via the flash tank 18.

FIG. 3 is showing a preferred two vessel, steam/liquor phase system, the digester comprising two concurrent cooking stages. This system principally differs from the system in FIG. 1 by not having an ITC™ stage. Instead the digester is presenting only two screen sections, which divide it into three stages, the lowermost being a conventional, short, counter current wash stage. The uppermost stage is the second (concurrent) cooking stage of the method according to the invention and the middle stage is the fourth (concurrent) cooking stage. The point of addition "A" of spent impregnation liquid 14*a* is located at a level with the uppermost screen section and the liquor 16 which is withdrawn from this screen section will constitute the first spent cooking liquor according to the method. The liquor 17'" which is withdrawn from the lowermost screen section, to be led to recovery, will be a combination of the second spent cooking liquor, from the fourth stage of the method, and a spent wash liquid from the concluding counter current wash stage. The concluding wash stage will, in this preferred embodiment, provide sufficient washing capacity so that a stage that combines counter current wash with modified continuous cooking, extended modified continuous cooking or ITC™, and which conventionally is located directly above the concluding short wash stage, can be abandoned.

FIG. 4 is showing a two vessel, steam/liquor phase system, the digester comprising one concurrent cooking stage and one counter current cooking stage. This embodiment is essentially similar to the one in FIG. 3, the main difference being that the fourth stage of the method is performed as a counter current stage. The first end second spent cooking liquors are combined in 16, 17', one part 5 being conveyed to the preimpregnation vessel 1 and the remaining part 16*b* being led to recovery via the flash tank 18. The lowermost screen section includes a circulation system 19, 20 and 21 for keeping up the temperature in the fourth stage, and also a withdrawal conduit 17"" which leads to recovery.

Turning now to FIGS. 5–8, showing single vessel systems, they principally differ from the two vessel systems of FIGS. 1–4 in that the impregnation stage is included in the digester, as an extra stage below the top separator. No separate preimpregnation vessel is therefor needed. Apart from this major difference, the general principle of operation, as concerns the method of the invention, is essentially the same, why FIGS. 5–8 will not be described in detail. Only the essential differing features are described in the following. Reference numerals corresponding to the ones in FIGS. 1–4 have been used, with the addition of "5" as a prefix. FIG. 5 is showing a single vessel, hydraulic type system, the digester 52 comprising one concurrent impregnation stage 51, two concurrent cooking stages and one counter current ITC™ stage. In this embodiment, the feeding-in system also comprise a steaming vessel X'. The fibre material is fed directly from the high pressure feeder to the top of the digester, by aid of top circulation 57', 58'. The digester is hydraulically filled with liquid, and consequently no steam is added to the top of digester. Instead, heating is achieved by the two uppermost screen sections being provided with circulation arrangements, including heat exchangers 524, 525, for heating of a liquid which is withdrawn from the screen sections and reintroduced in the digester via hanging central pipes. The impregnation stage 51 is located between these two uppermost screen sections and includes impregnation with spent cooking liquor (black liquor) which preferably is withdrawn from flash tank 518 and introduced 526 via the transfer circulation 57', 58'. Spent impregnation liquid is withdrawn through conduit 514 and is partly 514*a* reintroduced in the digester at a location A corresponding to the subsequent screen section, by means of a hanging central pipe, to be used in the fourth stage of the method which is a concurrent stage. The second stage of the method according to the invention is located above the point of addition A for spent impregnation liquid, and includes addition of white liquor 512. A first spent cooking liquor is withdrawn from the second stage of the method through conduit 516 and is led to recovery via a first flash tank 518. Also, though not shown, a major part of the withdrawn first spent cooking liquor may instead be conveyed to the top of the digester (below the top separator) and/or to the feed system. A second part 514*b* of the spent impregnation liquid from the impregnation stage is also led to recovery, via a second flash tank 518'. Through conduit 517 is a spent liquor, which is a combined second spent cooking liquor from the fourth stage and spent liquor from a counter current ITC™ stage, led to recovery via flash tank 518. The ITC™ stage may include addition of white liquor 512, preferably about 10–15% of the total amount of added white liquor, via the circulation 519, 520, 521 (stand pipe).

FIG. 6 is showing a single vessel, hydraulic type system, the digester comprising one concurrent impregnation stage, one concurrent cooking stage, one counter current cooking stage and one counter current ITC™ stage. The embodiment resembles the one in FIG. 5 with the major difference being that the fourth stage of the method is a counter current stage. The spent impregnation liquid 514*a*, which is rich in hemicellulose, is consequently added A at the end of the fourth stage, seen from the fibre material flow point of view. A combined first and second spent cooking liquor is withdrawn from the digester by conduit 516, 517' and is led to recovery via a first flash tank 518 and, though not shown, to the top of the digester and/or to the feed system. A spent liquor from the ITC™ stage, withdrawn by conduit 517", is also led to the first flash tank 518.

FIG. 7 is showing a single vessel, steam/liquor-phase system, the digester comprising one concurrent impregnation stage, one concurrent cooking stage and one counter current cooking stage (including ITC™). The embodiment resembles the one in FIG. 6, the major difference being that the fourth stage of the method, including the spent impregnation liquid which is rich in hemicellulose, is performed in a counter current stage which is combined with an ITC™ stage. This means that spent impregnation liquid 514*a* is added A to the digester in conjunction with the lowermost circulation 519, 520, 521, to which circulation also white liquor 512 may be added. The spent liquor which is withdrawn from the digester by conduit 516, 517''' is thus a combination of the first and second spent cooking liquors together with a spent ITC™ liquor and is partly recirculated 55' (preferably via a not shown cooler) to the impregnation stage and partly led 516*b* to recovery via a first flash tank 518. A part of the liquor which has been cooled in the flash tank 518 may also be conveyed to the feed system through conduit 526, which also may include a not shown cooler. Moreover, a spent wash liquor is withdrawn 517'''' from the lowermost screen section of the digester and is led to recovery via a second flash tank 518'.

FIG. 8 is showing a preferred single vessel, steam/liquor-phase system, the digester comprising one concurrent impregnation stage and two concurrent cooking stages. In this embodiment, spent impregnation liquid 514*a* is added A to the fourth stage of the method, in the digester, in conjunction with a combined second spent liquor and spent wash liquor which is withdrawn at the lowermost screen section by conduit 517''' and returned to the above lying screen section via heat exchanger 520' and hanging central pipe 521'. Also white liquor 512 may be added at the same point A. A part of the combined spent liquors is separated off, before the addition of spent impregnation liquid 514*a* and white liquor, and led to recovery via the second flash tank 518'. The first spent cooking liquor 516 is divided into one part 55' which (preferably via a not shown cooler) is recycled to the impregnation stage and one part 516*b* which is led to the feed system and/or to recovery via the first flash tank 518. Preferably, a major part of the liquor which exits the first flash tank 518 is led to the feed system through conduit 526 which, though not shown, may include a cooler. The concluding wash stage will, in this preferred embodiment, provide sufficient washing capacity so that a stage that combines counter current wash with modified continuous cooking, extended modified continuous cooking or ITC™, and which conventionally is located directly above the concluding short wash stage, can be abandoned.

FIG. 9 is, in a diagram, showing test results as screened yield versus kappa number for a cooked softwood pulp. Three test series were performed:

1. Reference, without any addition of a liquor rich in hemicellulose to the cooking.
2. Addition of a softwood spent impregnation liquid, rich in hemicellulose, to softwood cooking.
3. Addition of a hardwood spent impregnation liquid, even more rich in hemicellulose, to softwood cooking.

The results show a small increase in yield for test series 2 in relation to the reference 1. For test series 3, there was a 1%-unit increase in yield, which for a mill scale process would be a considerable increase.

Beatability tests were also made, measuring how many PFI revolutions was needed to achieve a tensile strength of 80 kNm/kg for three pulps which had been cooked according to the three test series above. The results in each test series were interpolated and showed that 950 PFI revolutions was needed for the reference pulp (1), whereas 750 PFI revolutions was needed for pulp 2 (a 20% decrease in beating demand) and only 700 for pulp 3 (a 25% decrease in beating demand).

The invention is not limited by the shown embodiments, but may be varied within the scope of the claims. The man skilled in the art will have no problem in presenting additional embodiments of the invention, given the possibility to combine the different features shown in the figures. For example the embodiments of FIGS. 5 and 6, may also include a branch conduit from conduit 516 to convey a part of the first spent cooking liquid to the beginning of the impregnation stage in the top of the digester, at a point immediately below the top separator. A further example of a variation which will be easily seen by the skilled man is to conduct the fourth stage of the method in a counter current manner in FIG. 8. He will also see the possibility to conduct the fourth stage of the method according to the invention in a separate stage, after the digester and thus not truly a part of the cooking, where possibly acid is added to make the hemicellulose, and especially xylan, precipitate onto the fibre material. Additionally, it is conceivable to add liquor which is rich in hemicellulose, especially xylan, to the fourth stage of the method, which liquor may have its origin in another part of the system as shown in the drawings, or even in a completely different part of the pulp mill.

What is claimed is:

1. A method for continuous cooking of lignocellulosic fiber material, comprising:

providing a vessel system having a first stage, second stage, third stage and a concurrent fourth stage, the third stage and fourth stage being separated by a screen, the vessel system having a fiber material disposed therein, the fourth stage being subsequent to the third stage, the third stage being subsequent to the second stage and the second stage being subsequent to the first stage;

in the first stage, impregnating the fiber material with an impregnation liquid;

in the first stage, withdrawing a hemicellulose rich spent impregnation liquid from the vessel system;

in the second stage, cooking the fiber material in a first cooking liquor;

in the third stage, withdrawing a first spent cooking liquor through the screen and adding the hemicellulose rich spent impregnation liquid to the fiber material at a beginning of the concurrent fourth stage; and in the concurrent fourth stage, cooking the fiber material in a second cooking liquor comprising the portion of the hemicellulose rich spent impregnation liquid added in the third stage and concurrently passing the hemicellulose rich spent impregnation liquid in the concurrent fourth stage and retaining the fiber material in the concurrent fourth stage together with the portion of the hemicellulose rich spent impregnation liquid for at least one hour and allowing the hemicellulose to precipitate onto the fiber material.

2. The method according to claim 1 wherein the retention time is at least 1.5 hours.

3. The method according to claim 1 wherein the method further comprises adding a liquid comprising a fresh alkali metal hydroxide to the second stage and obtaining a cooking liquor concentration of effective alkali, calculated as NaOH, of at least 20 g/l when the fiber material is soft wood.

4. The method according to claim 1 wherein the method further comprises adding a liquid comprising a fresh alkali metal hydroxide to the second stage and obtaining a cooking liquor concentration of effective alkali, calculated as NaOH, of between about 30 g/l and about 50 g/l when the fiber material is soft wood.

5. The method according to claim 1 wherein the method further comprises adding a liquid comprising a fresh alkali metal hydroxide to the second stage and obtaining a cooking liquor concentration of effective alkali, calculated as NaOH, of about 40 g/l when the fiber material is soft wood.

6. The method according to claim 1 wherein the method further comprises adding a liquid comprising a fresh alkali metal hydroxide to the second stage and obtaining a cooking liquor concentration of effective alkali, calculated as NaOH, of at least 10 g/l when the fiber material is hard wood.

7. The method according to claim 1 wherein the method further comprises adding a liquid comprising a fresh alkali metal hydroxide to the second stage and obtaining a cooking liquor concentration of effective alkali, calculated as NaOH, of between about 12 g/l and about 25 g/l when the fiber material is hard wood.

8. The method according to claim 1 wherein the method further comprises adding a liquid comprising a fresh alkali metal hydroxide to the second stage and obtaining a cooking liquor concentration of effective alkali, calculated as NaOH, of about 15 g/l when the fiber material is hard wood.

9. The method according to claim 1 wherein the portion of the spent impregnation liquid added in the third stage is at least 20 percent of the spent impregnation liquid that is withdrawn in the first stage.

10. The method according to claim 9 wherein the method further comprises adding a liquid comprising a fresh metal hydroxide to the fiber material together with the spent impregnation liquid that is added to the fiber material in the third stage.

11. The method according to claim 1 wherein the portion of the spent impregnation liquid added in the third stage is at least 30 percent of the spent impregnation liquid that is withdrawn in the first stage.

12. The method according to claim 1 wherein the portion of the spent impregnation liquid added in the third stage is at least 40 percent of the spent impregnation liquid that is withdrawn in the first stage.

13. The method according to claim 1 wherein method further comprises withdrawing a first spent cooking liquor from the second stage and supplying a substantial portion of the first spent cooking liquor to the first stage.

14. The method according to claim 13 wherein the method further comprises supplying a substantial portion of the first spent cooking liquor to a beginning of the first stage.

15. The method according to claim 13 wherein the substantial portion is at least 80 percent of the first spent cooking liquor withdrawn from the second stage.

16. The method according to claim 13 wherein the substantial portion is at least 90 percent of the first spent cooking liquor withdrawn from the second stage.

17. The method according to claim 13 wherein the substantial portion is about 100 percent of the first spent cooking liquor withdrawn from the second stage.

18. The method according to claim 1 wherein the method further comprises conveying a spent cooking liquor withdrawn from the fourth stage together with a portion of the spent impregnation liquid from the first stage to a recovery unit.

19. The method according to claim 18 wherein the method further comprises providing the second and the fourth stages with concurrent cooking stages.

20. The method according to claim 1 wherein the method further comprises providing the vessel system with a fifth stage comprising a washing stage having a retention time of up to 60 minutes.

21. The method according to claim 20 wherein the retention time is at least 10 minutes and the fifth stage is a counter-current stage.

22. A method for continuous cooking of lignocellulosic fiber material, comprising:

providing a vessel system having a first stage, second stage, third stage and a concurrent fourth stage, the third stage and fourth stage being separated by a screen, the vessel system having a fiber material disposed therein;

in the first stage, impregnating the fiber material with an impregnation liquid comprising alkali metal hydroxide;

in the first stage, withdrawing a hemicellulose rich spent impregnation liquid from the vessel system;

in the second stage, cooking the fiber material in a first cooking liquor comprising alkali metal hydroxide;

in the third stage, withdrawing a first spent cooking liquor through the screen and adding a liquid containing a substantial portion of the hemicellulose rich spent impregnation liquid to the fiber material at a beginning of the concurrent fourth stage; and concurrently passing the hemicellulose rich impregnation liquid to the concurrent fourth stage and cooking the fiber material in the hemicellulose rich liquid added in the third stage and retaining the fiber material in the concurrent fourth stage together with the substantial portion of the hemicellulose rich impregnation liquid for at least one hour and allowing the hemicellulose to precipitate onto the fiber material.

23. The method according to claim 22 wherein the retention time is at least 1.5 hours.

24. The method according to claim 22 wherein the method further comprises adding a liquid comprising a fresh alkali metal hydroxide to the second stage and obtaining a cooking liquor concentration of effective alkali, calculated as NaOH, of at least 20 g/l when the fiber material is soft wood.

25. The method according to claim 22 wherein the method further comprises adding a liquid comprising a fresh alkali metal hydroxide to the second stage and obtaining a cooking liquor concentration of effective alkali, calculated as NaOH, of between about 30 g/l and about 50 g/l when the fiber material is soft wood.

26. The method according to claim 22 wherein the method further comprises adding a liquid comprising a fresh alkali metal hydroxide to the second stage and obtaining a cooking liquor concentration of effective alkali, calculated as NaOH, of about 40 g/l when the fiber material is soft wood.

27. The method according to claim 22 wherein the method further comprises adding a liquid comprising a fresh alkali metal hydroxide to the second stage and obtaining a cooking liquor concentration of effective alkali, calculated as NaOH, of at least 10 g/l when the fiber material is hard wood.

28. The method according to claim 22 wherein the method further comprises adding a liquid comprising a fresh alkali metal hydroxide to the second stage and obtaining a cooking liquor concentration of effective alkali, calculated as NaOH, of between about 12 g/l and about 25 g/l when the fiber material is hard wood.

29. The method according to claim 22 wherein the method further comprises adding a liquid comprising a fresh alkali metal hydroxide to the second stage and obtaining a cooking liquor concentration of effective alkali, calculated as NaOH, of about 15 g/l when the fiber material is hard wood.

30. The method according to claim 22 wherein the method further comprises adding a liquid comprising a fresh metal hydroxide to the fiber material together with the liquid containing a substantial portion of hemicellulose.

31. A method for continuous cooking of lignocellulosic fiber material comprising:

providing a first fiber line comprising a first raw fiber material;

providing a second fiber line comprising a second raw fiber material, the second fiber line having an upper cooking zone and a lower concurrent cooking zone, the upper cooking zone being separated from the lower concurrent cooking zone by a screen;

impregnating the first fiber material in an impregnation liquid comprising an alkali metal hydroxide;

withdrawing a hemicellulose rich spent impregnation liquid from the first fiber material in the first fiber line;

cooking the second fiber material in the upper cooking zone;

withdrawing a first spent cooking liquor from the screen and conducting the first spent cooking liquor back to the first fiber line;

adding a portion of the withdrawn hemicellulose rich spent impregnation liquid to a beginning of the lower concurrent cooking zone of the second fiber material in the second fiber line; and cooking the second fiber material in the lower concurrent cooking zone in a cooking liquor comprising the hemicellulose rich spent impregnation liquid from the first fiber material and retaining the fiber material in the cooking liquor together with the hemicellulose rich spent impregnation liquid for at least one hour and allowing the hemicellulose to precipitate onto the fiber material.

32. The method according to claim 31 wherein the method further comprises impregnating the second fiber material in an impregnation liquid comprising alkali metal hydroxide and thereafter cooking the second fiber material in a cooking liquor comprising alkali metal hydroxide and adding the spent impregnation liquid from the first fiber line to the second fiber line.

33. The method according to claim 31 wherein the retention time is at least 1.5 hours.

34. The method according to claim 31 wherein the method further comprises adding a liquid comprising a fresh alkali metal hydroxide to the cooking step and obtaining a cooking liquor concentration of effective alkali, calculated as NaOH, of at least 20 g/l when the fiber material is soft wood.

35. The method according to claim 31 wherein the method further comprises adding a liquid comprising a fresh alkali metal hydroxide to the cooking step and obtaining a cooking liquor concentration of effective alkali, calculated as NaOH, of between about 30 g/l and about 50 g/l when the fiber material is soft wood.

36. The method according to claim 31 wherein the method further comprises adding a liquid comprising a fresh alkali metal hydroxide to the cooking step and obtaining a cooking liquor concentration of effective alkali, calculated as NaOH, of about 40 g/l when the fiber material is soft wood.

37. The method according to claim 31 wherein the method further comprises adding a liquid comprising a fresh alkali metal hydroxide to the cooking step and obtaining a cooking liquor concentration of effective alkali, calculated as NaOH, of at least 10 g/l when the fiber material is hard wood.

38. The method according to claim 31 wherein the method further comprises adding a liquid comprising a fresh alkali metal hydroxide to the cooking step and obtaining a cooking liquor concentration of effective alkali, calculated as NaOH, of between about 12 g/l and about 25 g/l when the fiber material is hard wood.

39. The method according to claim 31 wherein the method further comprises adding a liquid comprising a fresh alkali metal hydroxide to the cooking step and obtaining a cooking liquor concentration of effective alkali, calculated as NaOH, of about 15 g/l when the fiber material is hard wood.

40. The method according to claim 31 wherein the method further comprises adding a liquid comprising a fresh metal hydroxide to the second fiber material together with a portion of the spent impregnation liquid from the first fiber material.

41. A method for continuous cooking of lignocellulosic fiber material, comprising:

providing a vessel system having a first stage, second stage, third stage and a concurrent fourth stage, the third stage and forth stage being separated by a screen, the vessel system having a fiber material disposed therein, the fourth stage being subsequent to the third stage that is subsequent to the second stage that is subsequent to the first stage;

in the first stage, impregnating the fiber material in an impregnation zone with an impregnation liquid comprising alkali metal hydroxide;

in the first stage, withdrawing a hemicellulose rich spent impregnation liquid from the vessel system;

in the second stage, cooking the fiber material in a first cooking liquor comprising alkali metal hydroxide;

at an end of the second stage, withdrawing a first spent cooking liquor through the screen and conducting the first spent cooking liquor to the impregnation zone;

in the third stage, adding the hemicellulose rich spent impregnation liquid to the fiber material at a beginning of the concurrent fourth stage, the beginning of the fourth stage being remote from the third stage; and passing the hemicellulose rich impregnation liquid in the fourth stage and cooking the fiber material in a second cooking liquor comprising the hemicellulose rich spent impregnation liquid added in the third stage and retaining the fiber material in the fourth stage together with the hemicellulose rich spent impregnation liquid for at least one hour and allowing the hemicellulose to precipitate onto the fiber material.

* * * * *